US007069181B2

(12) United States Patent
Jerg et al.

(10) Patent No.: US 7,069,181 B2
(45) Date of Patent: Jun. 27, 2006

(54) METHOD OF DETERMINING THE ENERGY AND WATER CONSUMPTION OF DISHWASHERS, AND DISHWASHERS

(75) Inventors: Helmut Jerg, Giengen (DE); Michael Rosenbauer, Reimlingen (DE); Bernd Schessl, Dillingen (DE)

(73) Assignee: BSH Bosch und Siemens Hausgeräte, Munich (DE)

( * ) Notice: Subject to any disclaimer, the term of this patent is extended or adjusted under 35 U.S.C. 154(b) by 0 days.

(21) Appl. No.: 10/873,446

(22) Filed: Jun. 21, 2004

(65) Prior Publication Data

US 2005/0114049 A1 May 26, 2005

Related U.S. Application Data

(63) Continuation of application No. PCT/EP02/13250, filed on Nov. 25, 2002.

(30) Foreign Application Priority Data

Dec. 21, 2001 (DE) ..... 101 63 192.8

(51) Int. Cl.
*B08B 3/00* (2006.01)
*G06F 15/00* (2006.01)

(52) U.S. Cl. ..... 702/182; 134/200

(58) Field of Classification Search ..... 702/182, 702/188; 134/200; 312/228
See application file for complete search history.

(56) References Cited

U.S. PATENT DOCUMENTS 3,217,721 A 11/1965 Hertel
3,586,011 A 6/1971 Mazza
3,718,149 A 2/1973 Mazza
5,470,142 A 11/1995 Sargeant et al.
6,189,551 B1 * 2/2001 Sargeant et al. ..... 134/200
6,260,565 B1 7/2001 Welch et al.

FOREIGN PATENT DOCUMENTS

FR 1 374 922 11/1963
WO 93/12706 7/1993
WO 98/33426 8/1998
WO 01/93741 A1 12/2001

OTHER PUBLICATIONS

Department of Energy; Dec. 18, 2001; Rules and Regulations; vol. 66, No. 243; pp. 65091-65097.*

* cited by examiner

*Primary Examiner*—Marc S. Hoff
*Assistant Examiner*—Paul Kim
(74) *Attorney, Agent, or Firm*—John Winburn; Russell W. Warnock; Craig J. Loest

(57) ABSTRACT

A method for detecting the energy and water consumption of dishwashers, whereby an energy/water consumption rating can be optimized for dishwashers. The amount of energy and water required to operate dishwashers containing at least two separate washing systems, each having a separate closable washing container, is detected separately for each washing system, and the energy/water consumption is rated on the basis of the amount of energy and water detected for each washing system. A dishwasher preferably is provided with at least two separate washing systems, each having a separate closable washing container, in which the energy and water consumption is detected and rated according to the method in order to optimize the energy/water consumption rating.

3 Claims, 2 Drawing Sheets

METHOD OF DETERMINING THE ENERGY AND WATER CONSUMPTION OF DISHWASHERS, AND DISHWASHERS

CROSS-REFERENCE TO RELATED APPLICATION

This application is a continuation, under 35 U.S.C. § 120, of copending international application No. PCT/EP02/13250, filed Nov. 25, 2002, which designated the United States; this application also claims the priority, under 35 U.S.C. § 119, of German patent application No. 101 63 192.8, filed Dec. 21, 2001; the prior applications are herewith incorporated by reference in their entirety.

BACKGROUND OF THE INVENTION

Field of the Invention

The invention relates to a method of determining the energy and water consumption of dishwashers containing at least two separate dishwashing systems each with dedicated closeable dishwashing compartments, and to dishwashers containing at least two separate dishwashing systems each with dedicated closeable dishwashing compartments.

International Patent Disclosures WO 93/12706 and WO 98/33426 disclose dishwashers which have at least two separate dishwashing systems each with dedicated closeable dishwashing compartments. Since the individual dishwashing systems may also be disposed spatially separately from one another, they each have all the equipment which is necessary for dishwashers, for example a circulating pump, detergent-solution pump, control elements, etc. For assessing the energy-consumption/water-consumption rating, the respective dishwashing units are thus measured separately from one another.

Separate dishwashing systems may be used such that lightly soiled articles are introduced into one dishwashing system and heavily soiled articles are introduced into the other dishwashing system. Since the quantity of energy and water consumed is always dependent on the soiling and/or the selected dishwashing program, for the energy rating of dishwashers with at least two separate dishwashing systems, during habitual use, the energy and water consumption measured in one dishwashing system is low and the energy and water consumption measured in the other dishwashing system is elevated. If, for example, the energy and water consumption is measured in a first dishwashing compartment, which is preferably configured for relatively lightly soiled cutlery, then it may be stated that this consumption is usually low, whereas an elevated water and energy consumption is registered for the cleaning of heavily soiled articles. The difference between these assessment values increases as the difference between the respectively selected washing programs in the separate dishwashing compartments becomes more marked. Since there are two separate dishwashing systems, however, the assessment of one dishwashing system does not affect the other dishwashing system.

SUMMARY OF THE INVENTION

It is accordingly an object of the invention to provide a method of determining the energy and water consumption of dishwashers, and dishwashers which overcome the above-mentioned disadvantages of the prior art methods and devices of this general type, which makes it possible to optimize the energy-consumption/water-consumption rating of dishwashers and, furthermore, to provide dishwashers with an optimized energy-consumption/water-consumption rating.

With the foregoing and other objects in view there is provided, in accordance with the invention, a method for determining energy and water consumption of a dishwasher having at least two separate dishwashing systems each with dedicated closeable dishwashing compartments. The method includes the steps of determining a quantity of energy and water necessary for operating each of the dishwashing systems separately, and establishing an energy-consumption/water-consumption rating of the dishwasher from energy-consumption and water-consumption values of the dishwashing systems of the dishwasher.

The invention relates to a method of determining the energy and water consumption of dishwashers containing at least two separate dishwashing systems each with dedicated closeable dishwashing compartments. The quantity of energy and water that is necessary for operating the respective dishwashing systems is determined separately for each dishwashing system, and the energy-consumption/water-consumption rating of the dishwasher is established from the energy-consumption and water-consumption values of the respective dishwashing systems.

In accordance with an added mode of the invention, there is the step of using the energy-consumption and water-consumption values of individual ones of the dishwashing compartments to form a sum which forms a basis for assessing the energy-consumption/water-consumption rating.

With the foregoing and other objects in view there is further provided, in accordance with the invention, a dishwasher. The dishwasher contains at least two separate dishwashing systems each with dedicated closeable dishwashing compartments, and a control system for determining a quantity of energy and water necessary for operating each of the dedicated closeable dishwashing systems separately. An energy-consumption/water-consumption rating of the dishwasher is determined from the energy-consumption and water-consumption values of the dishwashing systems.

Other features which are considered as characteristic for the invention are set forth in the appended claims.

Although the invention is described herein as embodied in a method of determining the energy and water consumption of dishwashers, and dishwashers, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENTS

The invention relates to a method for determining the energy and water consumption of a dishwasher. For assessing energy-consumption and water-consumption values, appropriate control sets of dishes are inserted into at least two separate dishwashing systems, these sets of dishes being divided up in accordance with the degrees of soiling. For example, the articles introduced into the top dishwashing system are those which are relatively lightly soiled, and the articles which are inserted into the dishwashing system disposed beneath, or adjacent, to the top dishwashing system are those which are heavily soiled.

Figure 1:
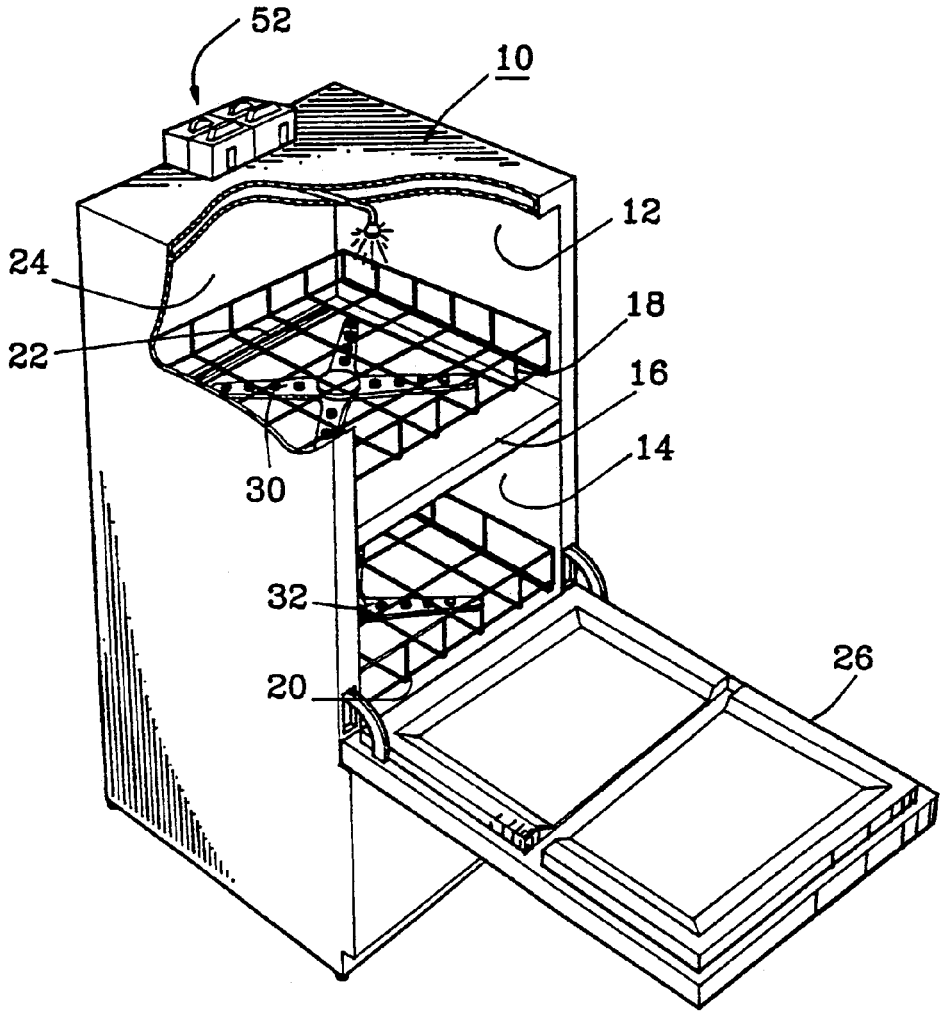
FIG. 1: Dishwashing Machine
Figure 2:
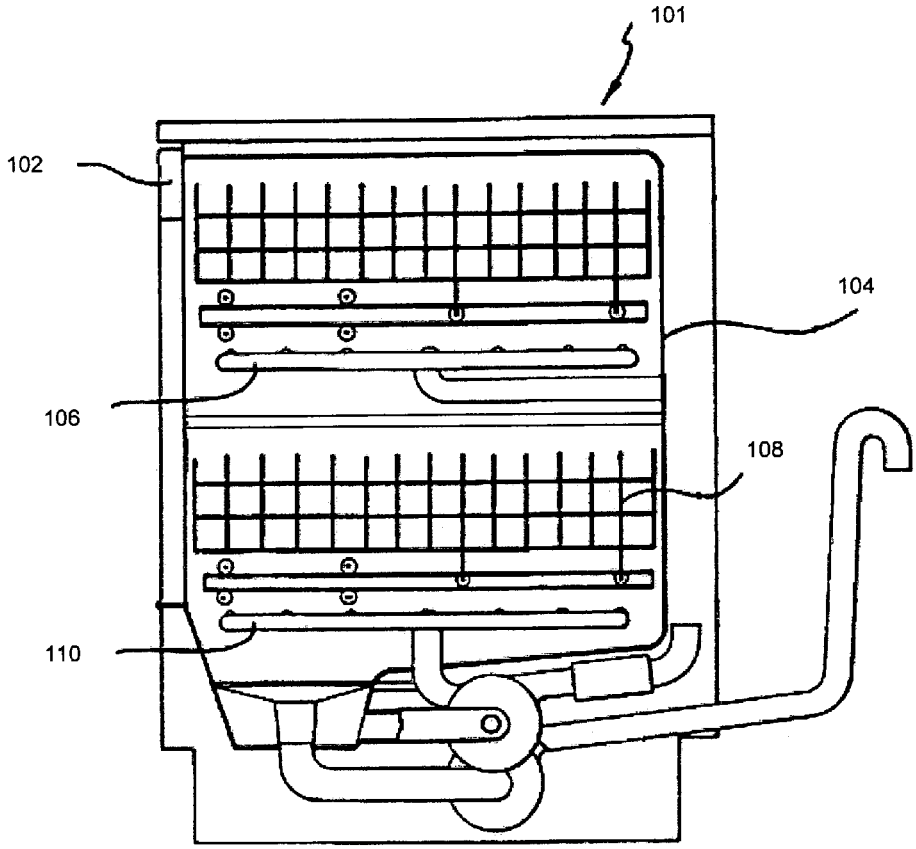
FIG. 2: Schematic drawing of a household dishwasher

Reference is had to U.S. Pat. No. 5,331,968 to Lim et al for a representative disclosure of a dishwashing machine having two separate dishwashing systems each with a dedicated closeable dishwashing compartment. With reference to FIG. 1 of the drawings herein, the dishwashing machine disclosed in U.S. Pat. No. 5,331,968 to Lim et al is described in that patent as comprising a housing or cabinet 10 which in turn includes a first washing compartment 12 and a second washing compartment 14 arranged one above the other. The first compartment 12 is spatially separated from the second compartment 14 by means of a partition wall 16. Each of the first and the second compartments 12 and 14 has a frontal opening that provides access to the interior of the first or second compartment 12 or 14. Positioned within the washing compartments 12 and 14 are dish-carrying racks 18 and 20 that may be slidably pushed into or taken out of the washing compartments 12 and 14 at the commencement or termination of a washing operation. The partition wall 16 has an elongate transverse slot 22 extending along the rear wall 24. The first washing compartment 12 communicates with the second washing compartment 14 through the transverse slot 22. Ideally, the slant angle of the partition wall is such that the wash water sprayed within the first compartment 12 may rapidly run down toward the rear wall 24 and then drained through the transverse slot 22 as quickly as possible. The frontal openings of the first and the second compartments 12 and 14 are openably closed by a door 26, the lower edge of which is hinged to the housing 10. Mounted on the top of the housing 10 is a washing aid supply unit 52 which may be structurally or functionally divided into a detergent supply device and a sterilizing agent supply device. Referring now to FIG. 2 of the drawings herein, there is schematically shown a household dishwasher 101 according to the invention. The operation of the dishwasher 101 is controlled by a program control unit 102. The household dishwasher 101 has a first dishwashing system 104 with a dedicated closeable dishwashing compartment having an associated spray device 106 and a second dishwashing system 108 with a dedicated closeable dishwashing compartment having an associated spray device 110. The first dishwashing system 104 is loadable with articles to be washed that are relatively lightly soiled and the second dishwashing system 108 is disposed beneath the first dishwashing system 104 and 108 loadable with articles to be washed that are relatively more heavily soiled than the articles to be washed loaded into the first dishwashing system 104. The program control unit 102 is operable as a control system for (a) separately determining a respective individual quantity of energy and water necessary for operating each of said first and second dishwashing systems 104, 108, (b) summing the respective individual energy-consumption and water-consumption values of the first and second dishwashing systems to form a sum which forms a basis for establishing the energy-consumption/water-consumption rating, and (c) establishing an energy-consumption/water-consumption rating of the dishwasher from the summed individual energy-consumption and water-consumption values of the first and second dishwashing systems 104, 108.

The respective dishwashing programs for achieving an optimum cleaning performance are selected in dependence on the respective degree of soiling. As a result of the specific dishwashing-program selection, the water and energy consumption in the dishwashing system which is merely occupied by relatively lightly soiled articles is low, whereas the water and energy consumption in the dishwashing system which is occupied by heavily soiled articles is considerably higher.

According to the invention, the resulting water-consumption and energy-consumption values, which are to form a basis for assessing the energy-consumption/water-consumption rating, are obtained by an addition of the respective energy-consumption and water-consumption values of the individual dishwashing systems.

Dishwashers with at least two dishwashing systems have, in particular, the advantage that the selection of the dishwashing programs can be tailored precisely to the degree of soiling of the articles, and the energy and water consumption is thus adapted to the respective requirements. The object of providing dishwashers with an optimized energy-consumption/water-consumption rating is achieved as now described. When a control set of dishes is washed in a dishwasher with at least two dishwashing systems, the energy and water consumption is reduced in relation to conventional dishwashers with just one dishwashing compartment, and according to the invention the individual consumption values are added. The resulting consumption value, despite the same dishwashing result, is lower than in the case of conventional dishwashers and, according to the invention, forms a basis for assessing the energy-consumption/water-consumption rating.

The invention has succeeded in specifying a method which makes it possible to optimize the energy-consumption/water-consumption rating of dishwashers and, furthermore, to provide dishwashers with an optimized energy-consumption/water-consumption rating.

We claim:

1. The method for determining energy and water consumption of a dishwasher having at least two separate dishwashing systems each with dedicated closeable dishwashing compartments, which comprises the steps of:

determining a quantity of energy and water necessary for operating each of the dishwashing systems separately;

establishing an energy-consumption/water-consumption rating of the dishwasher from energy-consumption and water-consumption values of the dishwashing systems of the dishwasher; and using the energy-consumption and water-consumption values of individual ones of the dishwashing compartments to form a sum which forms a basis for assessing the energy-consumption/water-consumption rating.

2. A dishwasher, comprising:

at least two separate dishwashing systems each with dedicated closeable dishwashing compartments; and a control system for determining a quantity of energy and water necessary for operating each of said dedicated closeable dishwashing systems separately, and establishing an energy-consumption/water-consumption rating of the dishwasher from the energy-consumption and water-consumption values of the dishwashing systems by (a) determining a quantity of energy and water necessary for operating each of the dishwashing systems separately, (b) establishing an energy-consumption/water-consumption rating of the dishwasher from energy-consumption and water-consumption values of the dishwashing systems of the dishwasher, and (c) using the energy-consumption and water-consumption values of individual ones of the dishwashing compartments to form a sum which forms a basis for assessing the energy-consumption/water-consumption rating.

3. A dishwasher, comprising:

a first dishwashing system with a dedicated closeable dishwashing compartment;

a second dishwashing system with a dedicated closeable dishwashing compartment, the first dishwashing system being loadable with articles to be washed that are relatively lightly soiled, and the second dishwashing system being disposed beneath, or adjacent, to the first dishwashing system and being loadable with articles to be washed that are relatively more heavily soiled than the articles to be washed loaded into the first dishwashing system; and a control system for (a) separately determining a respective individual quantity of energy and water necessary for operating each of said first and second dishwashing systems, (b) summing the respective individual energy-consumption and water-consumption values of the first and second dishwashing systems to form a sum which forms a basis for establishing the energy-consumption/water-consumption rating, and (c) establishing an energy-consumption/water-consumption rating of the dishwasher from the summed individual energy-consumption and water-consumption values of the first and second dishwashing systems.

* * * * *